US006671487B2

(12) United States Patent
Stringham

(10) Patent No.: US 6,671,487 B2
(45) Date of Patent: Dec. 30, 2003

(54) FUSER ASSEMBLY INCLUDING FIRST AND SECOND FUSERS

(75) Inventor: Gary G. Stringham, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/054,870

(22) Filed: Jan. 25, 2002

(65) Prior Publication Data

US 2003/0143003 A1 Jul. 31, 2003

(51) Int. Cl.[7] ..... G03G 15/20
(52) U.S. Cl. ..... 399/328; 219/216; 399/341
(58) Field of Search ..... 399/320, 328, 399/330, 341, 342; 219/216; 432/60

(56) References Cited

U.S. PATENT DOCUMENTS 4,223,203 A * 9/1980 Elter ..... 219/216
4,973,824 A * 11/1990 Ohashi et al. ..... 219/216
5,081,596 A 1/1992 Vincent et al. ..... 395/104
5,890,032 A * 3/1999 Aslam et al. ..... 399/341 X
6,236,830 B1 5/2001 Hoberock et al. ..... 399/330
6,246,842 B1 6/2001 McClure ..... 399/33
6,512,914 B2 * 1/2003 Kabashima ..... 399/341

* cited by examiner

*Primary Examiner*—William J. Royer

(57) ABSTRACT

A fuser assembly and associated method for an electrophotographic machine. The fuser assembly is preferably detachable and intended for use as a second or external fuser assembly. The fuser assembly contemplated may be used as a backup or a complimentary fuser assembly. An electrophotographic machine may include or be adapted to include a detachable or complimentary fuser assembly. Also, a method of electrophotographic printing or copying using a second or external fuser assembly.

24 Claims, 5 Drawing Sheets

FUSER ASSEMBLY INCLUDING FIRST AND SECOND FUSERS

TECHNICAL FIELD

The present invention relates generally to electrophotographic machines and to methods of using such machines. More particularly, the present invention relates to a fuser assembly in an electrophotographic machine.

BACKGROUND ART

A fuser assembly is used in an electrophotographic machine to fuse previously applied toner onto the surface of a print or copy medium, such as paper. A fuser assembly typically comprises a fuser roller in association with a pressure roller which work together to press the toner onto the print medium. As used herein, the word "print" and the various forms thereof are intended to include printing, copying, and any other form of electrophotographic image production (be it production of an image, text, or otherwise). No limitation is intended by or should be read into the use of the word print. The fuser roller is typically heated to increase the toner's adherence to the print medium. One method of achieving this result is to use toner with some meltable material such as a plastic so that when heated, the toner effectively melts onto and adheres to the print medium. A variety of methods are known to heat the fuser roller, including heating internally using a heating element, such as a fuser lamp.

Typically, the print medium is rolled between a fuser roller and another roller to ensure proper contact between the fuser roller and the print medium. Proper printing requires that the toner and print medium will reach a certain temperature to facilitate proper binding or adherence of the toner to the print medium. The temperature reached is a product of a variety of factors, including the initial temperature of the fuser roller, the type of print medium employed (e.g., thin paper, cardstock, cardboard, or transparencies), the time the print medium is in contact with the fuser roller, and the heat capacitance of the fuser roller. Where the heat capacitance of the fuser roller is relatively low, or the heat absorbance of the print medium is relatively high, a faser assembly often needs to operate more slowly to ensure proper fusing of toner to the print medium.

The increasing speed and function of electrophotographic printers and copiers has led to a decrease in the contact time between the print medium and the fuser roller. A prior solution to ensure that the print medium and toner reached sufficient temperature was to slow down the throughput of print medium through the printer or copier in order to increase the overall contact time between the print medium and the fuser roller. Throughput references the total amount of printing accomplished within a given time frame. This solution of slowing down the printer has become unacceptable given the present desire for high throughput and accurate printing.

Typically, most fuser rollers operate at one temperature. While this temperature may be suitable for one print medium while the printer is operating at a given speed, it often fails to provide the level of flexibility that might otherwise be provided or that is desired to suit a variety of printing functions. It is desirable to print on a variety of different medium, i.e., medium of different thicknesses and compositions. In many instances printing on thicker-than-normal medium gives rise to a need to adjust the fuser roller temperature and/or the printer throughput in order to sufficiently heat the thicker medium to ensure that the toner adheres to the medium properly. The same is true with printing on transparencies or other materials with varying heat capacitance.

SUMMARY

In one embodiment, a device for improved printing is provided. By operating two or more fusing apparatuses within the same image producing cycle, toner is more likely to be properly and adequately fused to print medium. Preferably, this improvement in fusing does not affect the operating speed of an image producing apparatus. This is achieved since the total time a given piece of print medium is in contact with a fuser assembly or otherwise being operated upon by a fuser assembly is at least doubled, by using at least two fusing devices. In accordance with one aspect, the present invention may help to ensure that fusing is not a rate limiting step to the overall throughput in an electrophotographic process.

In accordance with another aspect, the present invention relates to a device for forming images on at least one sheet of medium. The device includes an image forming section for forming an image on the sheet of medium, an output section located substantially downstream of the image forming section. The output section may or may not include a secondary fusing device. Where a secondary fusing device is included, it may be such that it is selectively used by the imaging forming section as needed. Alternatively, the device may include an image forming section, as well as a first fuser and a second fuser to bind toner on a sheet of media. The fusing devices are typically comprised of a plurality of rollers and a motor.

In yet another embodiment of the invention, a method of electrophotographic printing is disclosed. Preferably, the method includes the steps of fusing an image to a print medium with a first fuser and fusing the image to the print medium with a second fuser. Alternatively the method may include steps of determining whether the second fusing step is desired, and determining the temperature of the second fuser.

Additional advantages and novel features of the present invention will be set forth in part in the description which follows and in part will become apparent to those skilled in the art upon examination of the following or may be appreciated further by practice of the invention.

BRIEF DESCRIPTION OF THE DRAWINGS

Features and advantages of the present invention will become apparent to those stilled in the art from the following description with reference to the drawings in which.

DETAILED DESCRIPTION

For simplicity and illustrative purposes, the principles of the present invention are described by referring mainly to various exemplary embodiments thereof. Although the preferred embodiments of the invention are particularly disclosed herein, one of ordinary skin in the art will readily recognize that the same principles are equally applicable to, and can be implemented in other systems, and that any such variation would be within such modifications that do not part from the true spirit and scope of the present invention. Before explaining the disclosed embodiments of the present invention in detail, it is to be understood that the invention is not limited in its application to the details of any particular arrangement shown, since the invention is capable of other embodiments. The terminology used herein is for the purpose of description and not of limitation.

Figure 1:
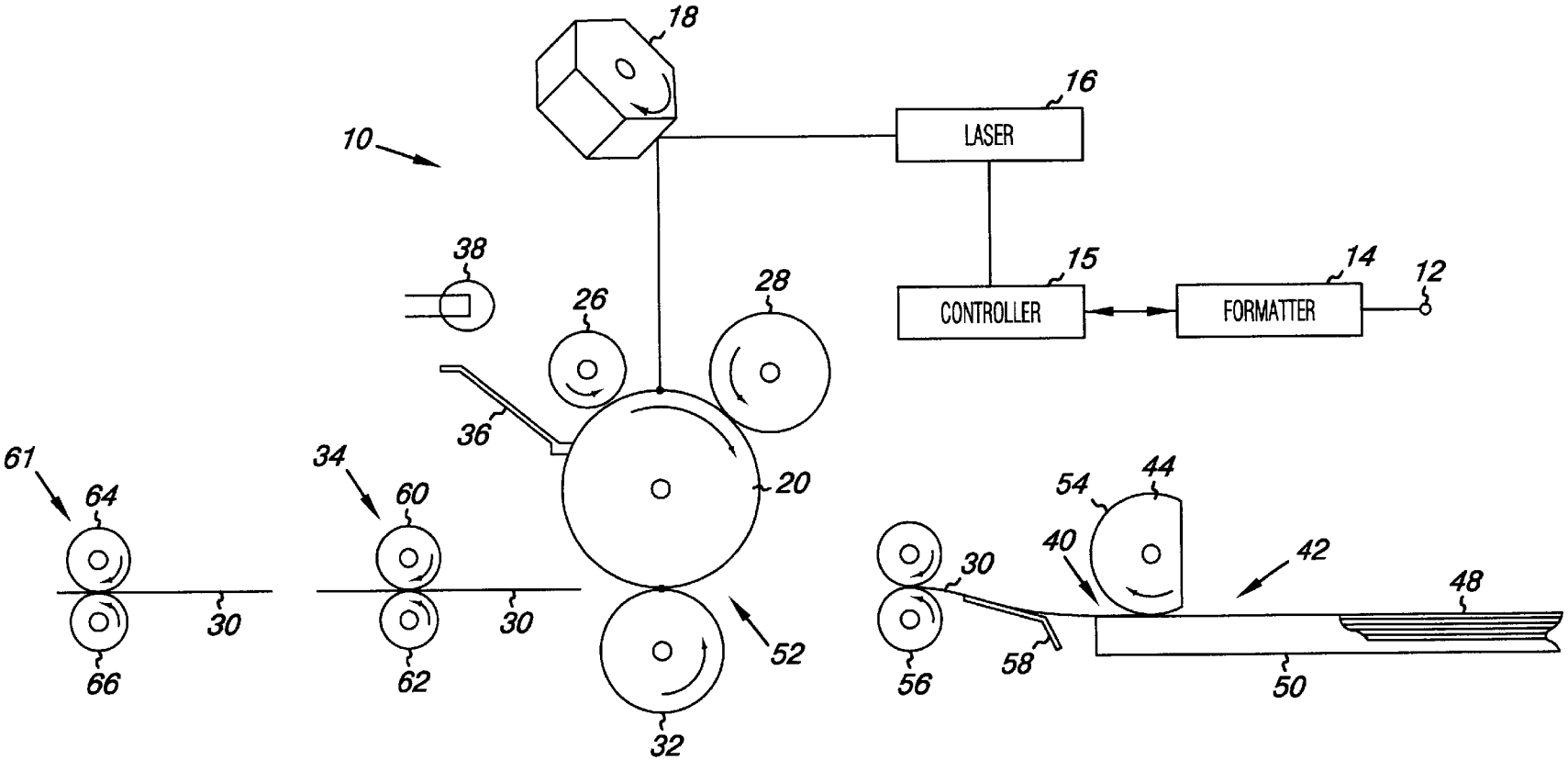
FIG. 1 is a representational view of a laser printer.

FIG. 1 illustrates an exemplary printing apparatus or printer, designated by reference number 10. A computer or other device (e.g., network, Internet, scanner) transmits data to an input port 12 of the printer 10. This data is analyzed in a formatter 14. Formatter 14 comprises a microprocessor, related programmable memory and preferably a page buffer. Formatter 14 formulates and stores an electronic representation of each page to be printed. Once the pages have been formatted, data is transmitted to a printer controller 15. Controller 15 fires laser 16 and controls the drive motor(s), fuser temperature and pressure, and any other print engine components and operating parameters.

The data is used to modulate the light being produced by laser 16. A light beam is reflected off a multifaceted spinning mirror 18. As each facet of the mirror 18 spins with the light beam, it reflects or "scans" the light beam across the side of a photoconductive drum 20. Photoconductive drum 20 rotates so that each successive scan of the light beam is recorded on photoconductive drum 20 immediately after the previous scan. In this manner, the data is recorded on photoconductive drum 20. Toner is electrostatically transferred from developing roller 28 onto photoconductive drum 20 according to the data previously recorded on the photoconductive drum 20 by the light beam. The toner is thereafter transferred from photoconductive drum 20 onto print medium 30 as print medium 30 passes between photoconductive drum 20 and a transfer roller 32. Photoconductive drum 20 is cleaned of excess toner with a cleaning blade 36. Photoconductive drum 20 may be completely discharged by discharge lamps 38 before a uniform charge is restored to the photoconductive drum 20 by charging roller 26, in preparation for the next toner transfer.

The print medium 30 is advanced to the photoconductive drum 20 by a pick/feed mechanism 42. Pick/feed mechanism 42 includes motor driven feed roller 44 and registration rollers 56. A stack of medium 48 is positioned in an input tray 50 to allow sliding passage of the top piece of print medium 30 into pick/feed area 40 at the urging of feed roller 44. In operation, as feed roller 44 rotates, the frictionally adherent outer surface 54 of feed roller 44 contacts the upper surface of print medium 30 and pulls it into pick/feed area 40. As a leading edge of the print medium 30 moves through pick/feed area 40, it is engaged between the pair of registration rollers 56. A ramp 58 may be used to guide print medium 30 into the registration rollers 56. Registration rollers 56 advance print medium 30 fully into image area 52 until it is engaged between photoconductive drum 20 and transfer roller 32, where toner is applied to the print medium 30 as described above. Once the toner is applied to print medium 30, it is advanced along the print medium path to fuser 34. Fuser 34 includes a heated fusing roller 60 and a pressure roller 62. In certain embodiments, the pressure roller 62 is also heated. As the print medium 30 passes between the rollers 60, 62, toner is fused to the print medium 30 through a process preferably involving heat and pressure.

Print medium 30 then passes along the print medium path to a second fuser 61. Second fuser 61 preferably includes a fusing roller 64 and a pressure roller 66. In a preferred embodiment, the fusing roller 64 is heated. In certain embodiments, the pressure roller 66 is also heated. Alternatively, the second fuser 61 may include a variety of fusing rollers and/or pressure rollers. As the print medium 30 passes between the rollers 64, 66, toner is fused to the print medium 30 through a process preferably involving heat and pressure.

In another embodiment, the printing apparatus 10 includes machinery (not shown) to optionally or selectively direct the print medium 30 through the second fuser 61. In this way, the second fuser 61 is only employed when necessary to complete the fusing process. The selection of whether or not to employ the second fuser 61 may be performed by a controller within the printing apparatus 10. The selection may ultimately depend upon a variety of factors, including input from a temperature gauge that checks the temperature of the print medium 30, or input from a user about whether to use the second fuser 64, or input from hardware or software that determines whether to use the second fuser 61, based on the type of print medium 30 being used or the operating temperature of the first fuser 34. The machinery that might enable the optional use of the second fuser 61 could vary widely. In a preferred embodiment this machinery includes components to route and pass the print medium 30 through the second fuser 61 or alternatively, to route and pass the print medium 30 around the second fuser 61.

Figure 2:
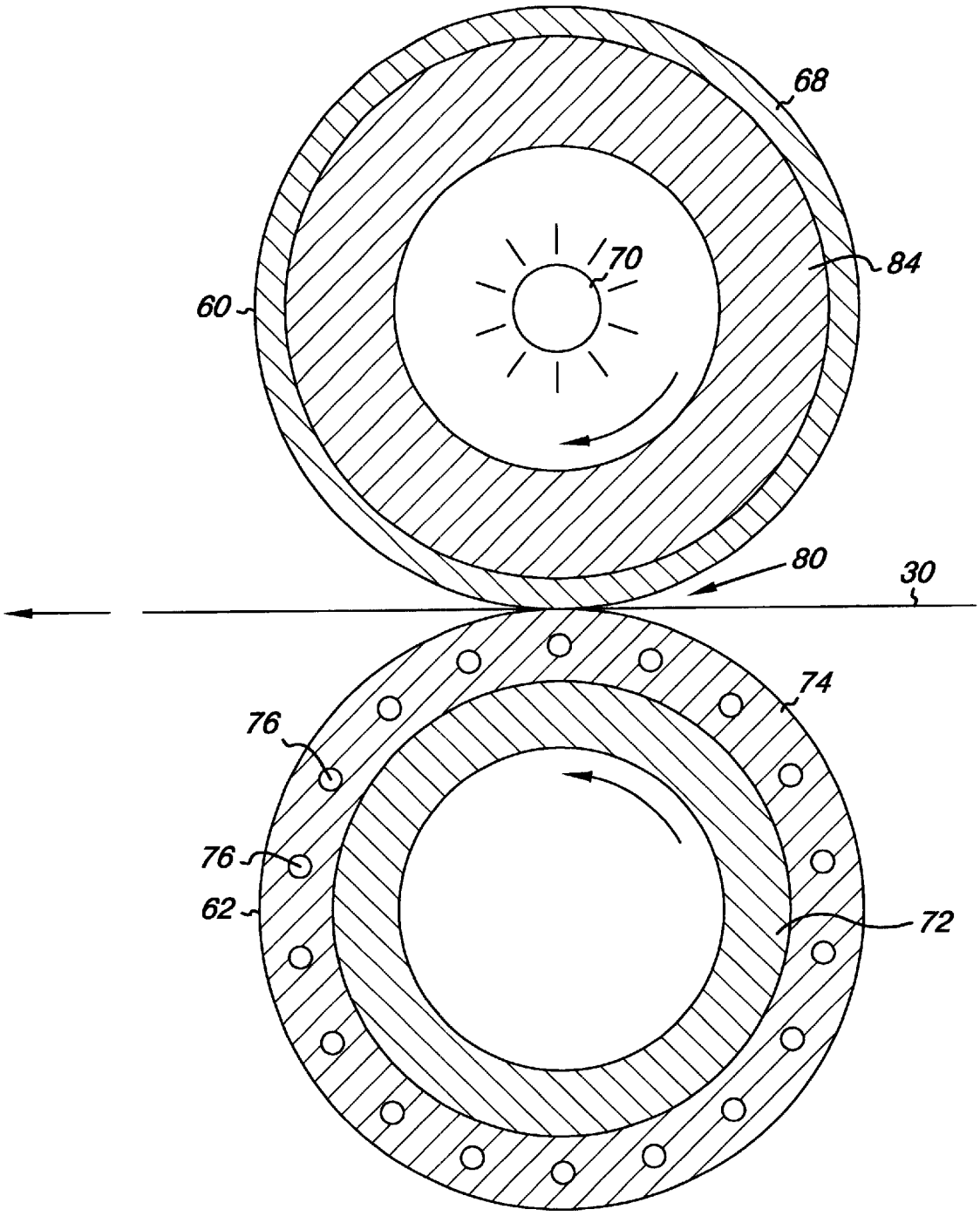
FIG. 2 is a side view of components in a fuser assembly in accordance with one embodiment of the present invention.

Referring to FIG. 2, the fusing roller 60 and pressure roller 62 are mounted on bearings (not shown) which are biased to press the fusing roller 60 and pressure roller 62 against one another. This assembly may be used as a first or second fuser 60, 61. The fusing roller 60 and pressure roller 62 engage to form a nip 80. Toner is fused to print medium 30 in nip 80. One or both rollers 60, 62 are motor driven to advance print medium 30 through nip 80. Fusing roller 60 is typically constructed with a metal core 84 and an outer layer 68. Outer layer 68 is often made of a hard material such as TEFLON™. Metal core 84 is typically hollow. A heating element 70 is positioned inside metal core 84 along the length of fusing roller 60. Pressure roller 62 is typically constructed with a metal core 72 and a relatively pliable outer layer 74. Pressure roller 62 may include a TEFLON™ release layer (not shown). Alternatively, pressure roller 62 may include its own heating system such as a heating element (not shown) within the metal core 72 or a series of heating wires 76 extending axially along the length of pressure roller 62.

Figure 3:
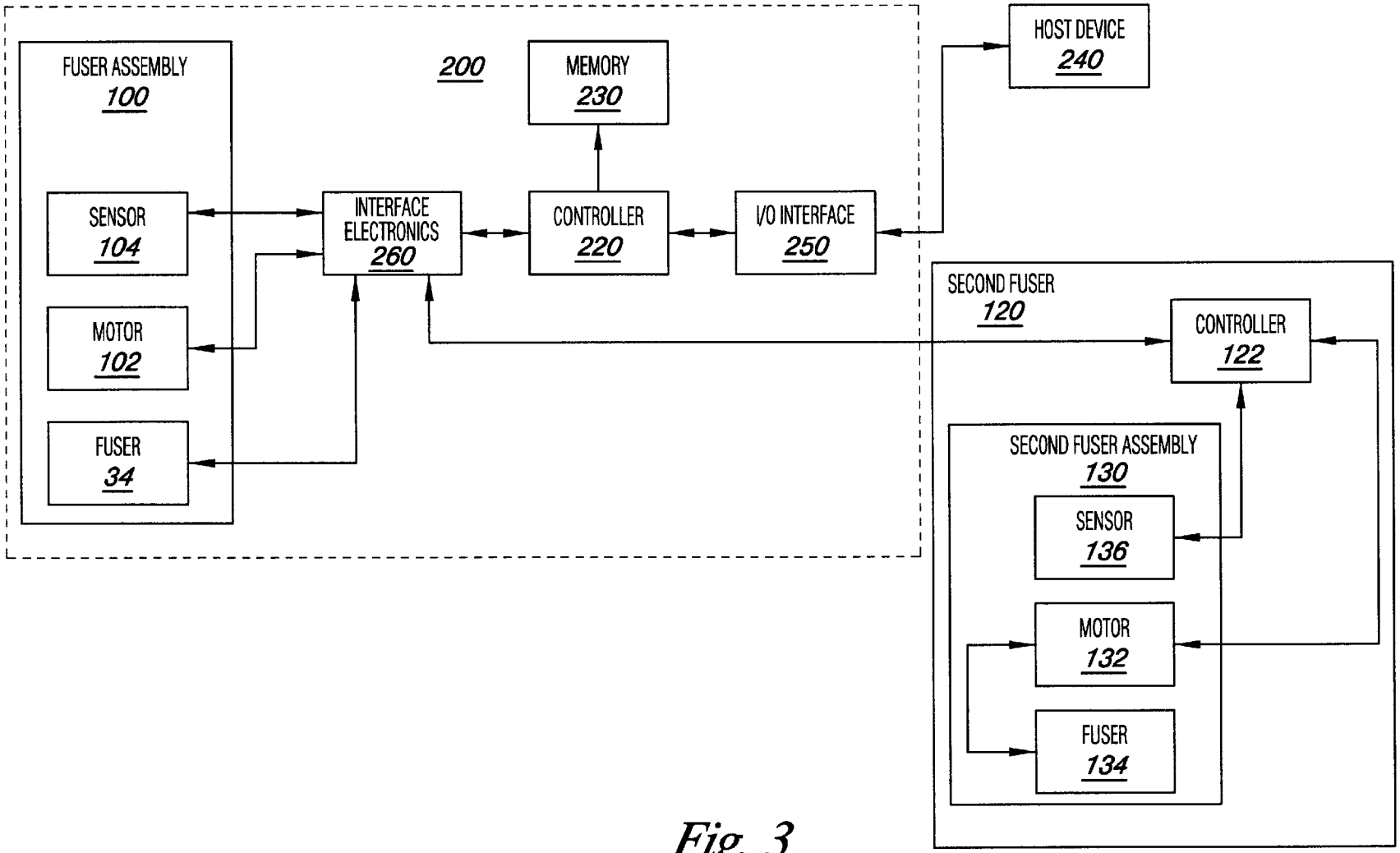
FIG. 3 is a representational block diagram of one embodiment of the present invention.

Referring to FIG. 3, there is illustrated an exemplary block diagram of an image producing apparatus 200 in accordance with the principles of one embodiment of the present invention. The following description of the exemplary block diagram illustrates one manner in which an image producing apparatus 200 may operate. In this respect, it is to be understood that the following description of the exemplary block diagram is but one of a variety of different manners in which the image producing apparatus 200 of the present invention may operate.

A fuser 34 may be rotated by operation of a motor 102. The fuser 34 is preferably configured to apply heat and pressure to print medium, such that with its rotation, toner adhering to the print medium becomes relatively permanently affixed to the print medium to form a particular image (e.g., picture, text, diagrams).

A controller 220 may be configured to provide control logic for a fuser assembly 100. In this respect, the controller 220 may possess a microprocessor, a micro-controller, an application specific integrated circuit, or the like. The controller 220 may be interfaced with a memory 230 configured to provide storage of a computer software that provides the functionality of the image producing apparatus 200. The memory 230 may also be configured to provide a temporary storage area for data or files received by the image producing apparatus 200 from a host device 240, such as a computer, server, workstation, image forming device, or the like. The memory 230 may be implemented as a combination of volatile and non-volatile memory, such as dynamic random access memory ("RAM"), EEPROM, flash memory, or the like. It is also within the purview of the present invention that the memory 230 may be included in the host device 240.

The controller 220 may further be interfaced with an I/O interface 250 configured to provide a communication channel between the host device 240, the image producing apparatus 200, and a second fuser 120. The I/O interface 250 may conform to protocols such as RS-232, parallel, small computer system interface, and universal serial bus. In addition, the controller 220 may be interfaced with the motor 102 and the fuser 34.

The image producing apparatus 200 preferably includes interface electronics 260 configured to provide an interface between the controller 220 and components (not shown) for manipulating the motor 102, for receiving data from a sensor 104, and for operating the second fuser 120. It may be appreciated from the foregoing that while the second fuser 120 is intended as a detachable device, it may be adapted so that it draws power from the image producing apparatus 200. In this way, the second fuser 120 does not require a separate power source. In an preferred embodiment, the second fuser 120 uses a separate power source. In such an embodiment, the second fuser 120 draws power from an external source other than the image producing apparatus 200. The second fuser 120 should also include the necessary electronics to interface with the controller 220 of the image producing apparatus 200. Preferably, these interface electronics transmit directly to a controller 122 of the second fuser 120. Alternatively, the second fuser 120 may lack its own controller 122 and may rely on the controller 220 of the image producing apparatus 200, or the image producing apparatus 200 may transmit directly from its controller 220 to the second fuser 120.

The image producing apparatus 200 is configured to detachably engage the second fuser 120. The second fuser 120 operates to further the fusing-process beyond that achieved by the fuser assembly 100. The second fuser 120 may include its own fuser controller 122, which may operate in a fashion similar to that of the controller 220 of the image producing apparatus 200. The fuser controller 122 may be configured to operate components within a second fuser assembly 130 and to communicate with the image producing apparatus 200, the host device 240, or another peripheral device (not shown).

The second fuser 120 includes the second fuser assembly 130 which includes a motor 132 adapted to operate a fuser 134. The motor 132 is preferably adapted to operate at varying speeds, while the second fuser assembly 130 is preferably adapted to operate at varying temperatures. The second fuser 120 may be adapted to control and adjust the operating temperature of the second fuser assembly 130 in response to varying inputs. The second fuser assembly 130 may also include a sensor 136 or multiple sensors (not shown) to determine, for instance whether the fuser 134 has reached sufficient operating temperature. The one or more sensors may operate in conjunction with the separate controllers 122 and 220, as well as the host device 240, in order to ensure that the fuser 134 has reached a temperature sufficient for the particular print medium being used. The second fuser 120 may also include interface electronics (not shown) similar to those depicted for the image producing apparatus 200. These interface electronics (not shown) would include electronics (both hardware and software) that facilitate communication between the image producing apparatus 200 and the second fuser assembly 130.

Figure 4:
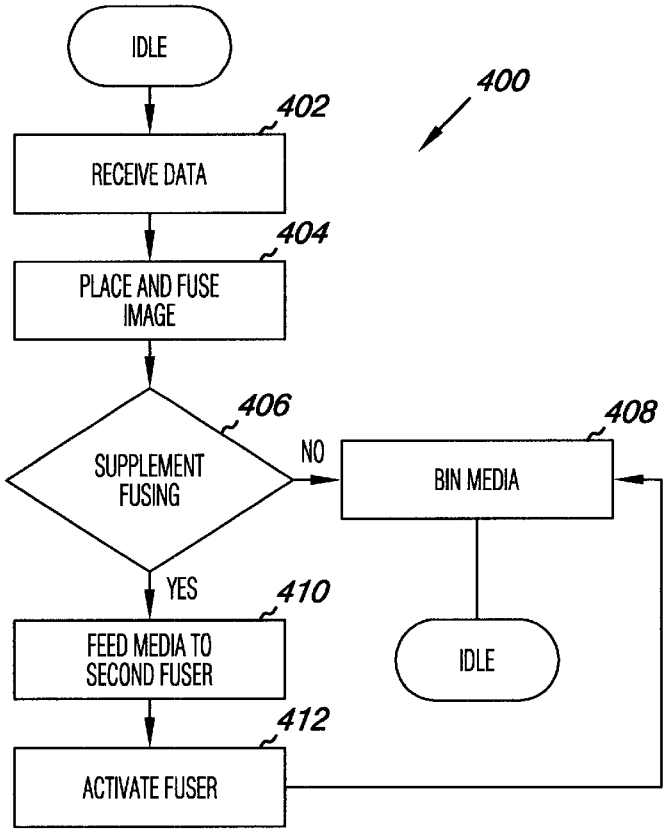
FIG. 4 is a flowchart depicting a method as contemplated in one embodiment of the present invention.

With reference to FIG. 4, there is illustrated an exemplary flow diagram 400 of a manner in which the principles of the present invention may be practiced. The following description of the flow diagram 400 is made with reference to the exemplary block diagram illustrated in FIG. 3, and thus makes reference to the elements illustrated therein. It is to be understood that the steps illustrated in the exemplary flow diagram 400 may be contained as a program, routine, or subroutine in any desired computer accessible medium. For purposes of this disclosure, such mediums, including the memory 230, may exist as internal and external computer memory units, and other types of computer accessible medium, such as a compact disc readable by a storage device. Thus, although particular reference is made in the following description of FIG. 3 to the controller 122 or 220 as performing certain functions of the image producing device, it is to be understood that those functions may be performed by any apparatus 200 capable of executing the above-described functions.

At step 402, data is received from the host device 240. This data includes image data as well as data relating to the necessary operating temperature of the second fuser 120 or the type of print medium about to be used or intended for a particular image producing job. Where the data relates to the operating temperature of the second fuser 120, it may be passed from the image producing apparatus controller 220 to the second fuser controller 122 and along to the second fuser assembly 130. Thus, the data may include a signal to check the temperature and return it to the image producing apparatus controller 220 for a time delay calculation prior to continuing the image producing process. Alternatively, the data may include a signal with the type of print medium to be employed, and leave any time delay calculation for the second fuser controller 122.

At step 404, the image is placed on and fused to the print medium as previously described with reference to FIGS. 1 and 2. At step 406, a determination is made as to whether supplemental basing is necessary. This may be determined by the image producing apparatus controller 220 where, for instance, secondary or supplemental basing is known to be unnecessary. Where supplemental fusing is determined to be unnecessary the process moves to step 408.

In step 408, the print medium is sent directly to a bin for later retrieval by a user, or for further processing or handling by another device, such as a stapler or binding apparatus. This step may be followed by deactivating the second fuser 120 where, for instance, no further print jobs are spooled or otherwise scheduled. This deactivating step may simply involve stopping the motors that drive the second fuser 120, and may also involve shutting off any heating elements associated with the second fuser 120.

Where supplemental fusing is determined to be desirable, the process moves to step 410. At step 410, the print medium is fed to a second fuser 120. At step 412, the second fuser 120 is activated and operates to further fuse the toner to the print medium. This activation step may involve activating the motors that drive the second fuser 120, and may also involve activating any heating elements associated with the second fuser 120. In the latter instance, activating any heating elements associated with the second fuser 120 may take place earlier in the process so as to allow ample time for the second fuser 120 to reach the desired operating temperature. The process then proceeds to step 408 as described above. Two high throughput fusers operating in this fashion may achieve the equivalent beating and pressure application of one fuser operating at a slower speed. In this way, print medium may be continuously fed through a printer with little to no delay attributable to fuser operation.

Figure 5:
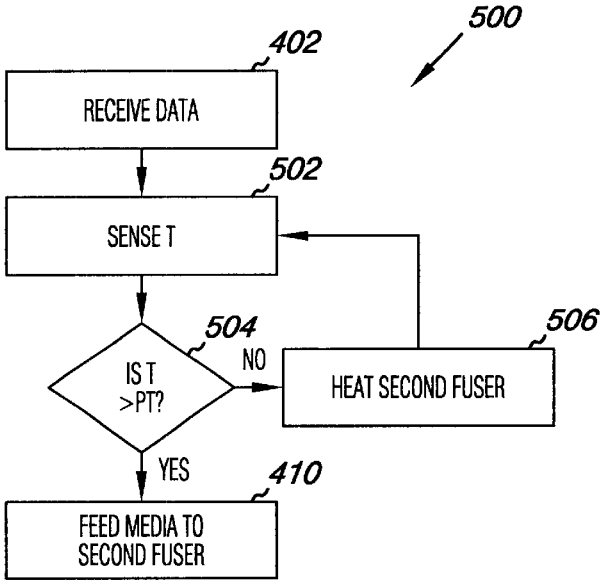
FIG. 5 is a flowchart depicting another method as contemplated in one embodiment of the present invention.

FIG. 5 shows an exemplary flow diagram of a heating process 500 in which the principles of the present invention may be practiced. The following description of the flow diagram 500 is made with reference to the exemplary block diagram illustrated in FIG. 3 and the flow diagram depicted in FIG. 4, and thus making reference to the elements illustrated therein. It is to be understood that the elements of the heating process 500 may exist as a program, routine, or subroutine within the process depicted in FIG. 4 and may be included within a subroutine of or as part of any computer accessible medium.

Where step 402, as previously described above, includes a signal to check the temperature of the second fuser assembly 130, the process continues to step 502 where a sensor 136 determines the temperature of the second fuser assembly 130. Step 504 involves determining whether the temperature returned by the sensor 136 is above a predetermined temperature. Step 504 may be carried out by either the image forming apparatus controller 220 or the second fuser controller 122. If the temperature returned by the sensor 136 is above a predetermined temperature then the process continues to step 410 and the print medium is fed to the fuser 120. If the temperature returned by the sensor 136 is below a predetermined temperature, then the process continues to step 506. At step 506, the second fuser 134 is heated to achieve an appropriate temperature. The process continues back to step 502 to recheck the temperature or alternatively may simply continue to step 410.

In certain instances it may be necessary to delay the image producing process of FIG. 4 while the heating process of FIG. 5 is completed. Preferably, a heating process of FIG. 5 is complete by the time step 410 of FIG. 4 is reached so that the print medium may proceed directly to the second fuser 120 without delay. This helps to ensure that a proper fusing temperature is reached by the print medium.

Figure 6:
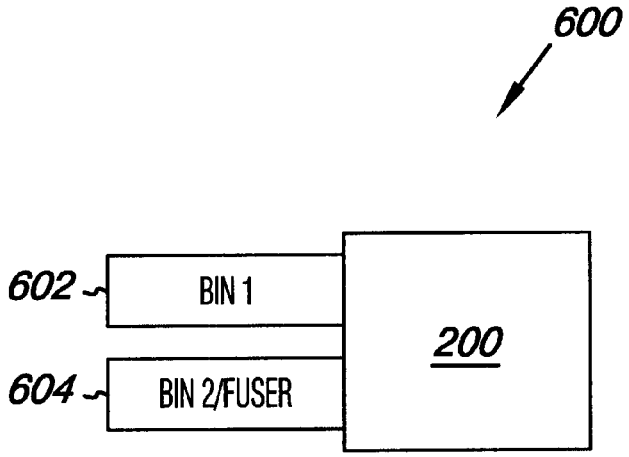
FIG. 6 is a representational block diagram in accordance with one embodiment of the present invention.

FIG. 6 depicts a block diagram of one embodiment of the present invention as a multi-bin image producing apparatus 600. In FIG. 6, an image producing apparatus 200 is shown with a first bin 602 and a second bin 604 affixed thereto. Both or either of these bins may be detachably connected to the image producing apparatus 200. The first bin 602 is intended for use when no secondary fusing is required. The second bin 604 is used when secondary fusing is required. The second bin 602 includes a fuser therewith or has a fuser attached thereto or is otherwise associated with a second fuser 120. For purposes of the present disclosure, the words "associated with" mean to be attached to, including detachable connections, or otherwise working in combination with. It should be appreciated that a variety of other bins may be attached to or associated with the image producing apparatus 200 of FIG. 6. This multi-bin image producing apparatus 600 is useful where for instance, a variety of print jobs are run through a single image producing apparatus and the print jobs vary in the type of print medium they employ.

As previously described with reference to FIG. 4, it is sometimes desirable to send print medium directly to a bin such as first bin 602 for further handling or storage for later retrieval. Alternatively, it is sometimes desirable to send print medium to a second fuser to complete the image creation process and ensure proper adherence of the toner to the print medium.

Figure 7:
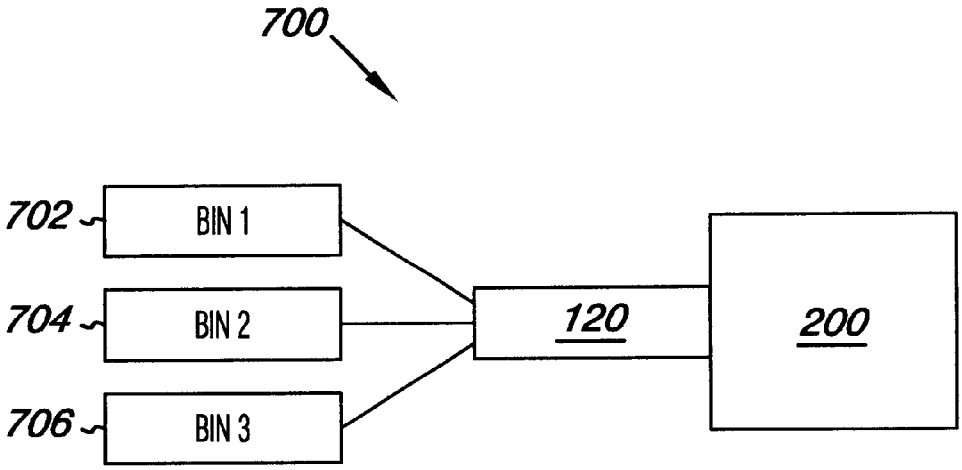
FIG. 7 is a representational block diagram in accordance with another embodiment of the present invention.

FIG. 7 depicts a block diagram of another, embodiment of the present invention as a multi-bin image producing apparatus 700. In FIG. 7, an image producing apparatus 200 is shown with a second fuser 120 detachably connected thereto or otherwise associated therewith. A variety of bins 702, 704, and 706 are associated with the second fuser 120. In this way, print medium is always run through the second fuser 120 before being delivered to one of the bins 702, 704, and 706. Where it is unnecessary to provide secondary fusing, print medium may pass directly through the second fuser 120. For instance, if the heating elements within the second fuser 120 are turned off. It should be appreciated that a variety of other bins may be attached to or associated with the image producing apparatus 200 of FIG. 7.

While the invention has been described with reference to certain exemplary embodiments thereof, those skilled in the art may make various modifications to the described embodiments of the invention without departing from the true spirit and scope of the invention. The term and descriptions used herein are set forth by way of illustration only and not meant as limitations. In particular, although the present invention has been described by examples, a variety of devices would practice the inventive concepts described herein. Thus, although the present examples relate to a printer, the present invention would have application to a copier, or any other electrophotographic image-producing device employing a fuser. Although the invention has been described and disclosed in various terms and certain embodiments, the scope of the invention is not intended to be, nor should be deemed to be, limited thereby and such other modifications or embodiments as may be suggested by the teachings herein are particularly reserved, especially as they fall within the breadth and scope of the claims here appended. Those skilled in the art will recognize that these and other variations are possible within the spirit and scope of the invention as defined in the following claims and their equivalents.

What is claimed is:

1. An electrophotographic device comprising:

a first fuser;

a second fuser located generally downstream of said first fuser; and wherein the second fuser is activated a predetermined time prior to fusing with said second fuser.

2. The device of claim 1, wherein the second fuser comprises: a controller.

3. The device of claim 1, wherein the second fuser comprises: a temperature sensor.

4. The device of claim 1, wherein the second fuser comprises: a heated roller.

5. The device of claim 1, wherein the second fuser is detachably mounted to the electrophotographic device.

6. The device of claim 1, wherein the second fuser is permanently mounted to the electrophotographic device and includes means to selectively direct print medium through the second fuser.

7. The device of claim 1, wherein the electrophotographic device is adapted to transmit signals to and receive signals from the second fuser.

8. The device of claim 1, wherein the electrophotographic device further comprises:

one or more bins for receiving print medium.

9. The device of claim 8, wherein one of the one or more bins for receiving print medium is associated with the second fuser.

10. The device of claim 1, wherein the second fuser is adapted to distribute print medium to one or more bins.

11. A device for forming images on a sheet of medium, said device comprising:

an image forming section for forming an image on at least one sheet of medium;

a first fuser configured to perform a first operation to bind toner on said at least one sheet of medium;

a second fuser located generally downstream of said first fuser, said second fuser being configured to perform a second operation to bind toner on said at least one sheet of medium; and a motor associated with the second fuser said motor is adapted to operate at varying speeds.

12. The device of claim 11, wherein the second fuser comprises:

a heating apparatus for heating the second fuser.

13. The device of claim 12, further comprising:

a housing adapted to house the second fuser, wherein the housing and second fuser are detachably engaged to the device for forming images.

14. The device of claim 11, wherein said second fuser is mounted to the device for forming images and includes means for communicating with a controller in the device.

15. A method of electrophotographic printing comprising:

fusing an image to a print medium with a first fuser;

fusing said image to said print medium with a second fuser; and determining whether the second fuser is at a predetermined temperature before fusing the image to the print medium with the first fuser.

16. The method of claim 15, further comprising:

determining whether said fusing with said second fuser is desired.

17. The method of claim 16, further comprising:

sending said print medium to a bin in response to said second fusing step being undesired; and fusing said image with said second fuser in response to said second fusing being desired.

18. The method of claim 15, further comprising:

sending the print medium to one of a variety of bins.

19. The method of claim 15, further comprising:

activating said second fuser a predetermined time prior to said fusing with said second fuser.

20. A device for forming images on a sheet of media, the device comprising:

an image forming component for forming an image on one or more sheets of media;

a first fuser configured to perform a first operation to bind toner on the one or more sheets of media; and a second fuser located generally downstream of the first fuser, the second fuser being configured to perform a second operation to bind toner on the one or more sheets of media, wherein the second fuser comprises:

a plurality of rollers, the plurality of rollers comprising at least one fuser roller and at least one pressure roller;

a motor associated with at least one of the plurality of rollers, wherein the motor is adapted to operate at varying speeds; and a heating apparatus for heating the at least one fuser roller.

21. A device for forming images on a sheet of media, the device comprising:

an image forming component for forming an image on one or more sheets of media;

a first fuser configured to perform a first operation to bind toner on the one or more sheets of media;

a second fuser located generally downstream of the first fuser, the second fuser being configured to perform a second operation to bind toner on the one or more sheets of media; and wherein the second fuser is at a predetermined temperature before fusing the image to the print media with the first fuser.

22. A device for forming images on a sheet of media, the device comprising:

an image forming component for forming an image on one or more sheets of media;

a first fuser configured to perform a first operation to bind toner on the one or more sheets of media;

a second fuser located generally downstream of the first fuser, the second fuser being configured to perform a second operation to bind toner on the one or more sheets of media; and wherein the second fuser is activated a predetermined time prior to fusing with said second fuser.

23. An electrophotographic device comprising:

a first fuser;

a second fuser located generally downstream of said first fuser; and wherein the second fuser is at a predetermined temperature before fusing an image to a print medium with the first fuser.

24. A method of electrophotographic printing comprising:

fusing an image to a print medium with a first fuser;

fusing the image to the print medium with a second fuser; and activating said second fuser a predetermined time prior to said fusing with said second fuser.

* * * * *